US008092354B2

(12) United States Patent
Oller, Jr.

(10) Patent No.: US 8,092,354 B2
(45) Date of Patent: Jan. 10, 2012

(54) PORTABLE AND ADJUSTABLE STRETCHING DEVICE

(76) Inventor: Rafael J. Oller, Jr., Miami, FL (US)

( * ) Notice: Subject to any disclaimer, the term of this patent is extended or adjusted under 35 U.S.C. 154(b) by 0 days.

(21) Appl. No.: 12/722,086

(22) Filed: Mar. 11, 2010

(65) Prior Publication Data

US 2010/0234192 A1 Sep. 16, 2010

Related U.S. Application Data

(60) Provisional application No. 61/159,171, filed on Mar. 11, 2009.

(51) Int. Cl.
*A62B 21/00* (2006.01)

(52) U.S. Cl. ..... 482/131; 482/139

(58) Field of Classification Search ..... 482/91, 482/121, 131, 139, 140, 148, 907; D21/691, D21/692; 74/551.3, 551.4, 594.1, 594.7
See application file for complete search history.

(56) References Cited

U.S. PATENT DOCUMENTS

| | | | | |
|---|---|---|---|---|
| 715,530 | A | 12/1902 | Wallace | |
| 1,410,149 | A | 3/1922 | Williams et al. | |
| 2,223,309 | A | 11/1940 | Swanson | |
| 2,414,275 | A * | 1/1947 | Schwinn | 74/551.4 |
| 2,706,631 | A | 4/1955 | Holmes | |
| D182,660 | S | 4/1958 | Hastings | |
| 3,228,683 | A | 1/1966 | Leteff | |
| 3,369,809 | A | 2/1968 | Morrill, Jr. | |
| 3,397,884 | A | 8/1968 | Blasi | |
| 3,430,953 | A | 3/1969 | Teetor | |
| 3,502,326 | A | 3/1970 | Schaeffer | |
| 3,722,507 | A | 3/1973 | Krause | |
| 3,985,354 | A | 10/1976 | Schulkin | |
| D247,789 | S * | 4/1978 | Belkir | D21/692 |
| 4,111,414 | A | 9/1978 | Roberts | |
| 4,227,688 | A | 10/1980 | Senoh et al. | |
| 4,292,962 | A | 10/1981 | Krause | |
| 4,344,618 | A | 8/1982 | Dudley | |
| 4,372,552 | A | 2/1983 | Carlmark | |
| 4,517,966 | A * | 5/1985 | von Othegraven | 482/122 |
| 4,566,693 | A | 1/1986 | Seidentop et al. | |
| 4,634,119 | A | 1/1987 | Pesthy | |
| 4,693,470 | A | 9/1987 | Ogawa | |
| D292,427 | S * | 10/1987 | Baburek | D21/692 |
| 4,703,929 | A | 11/1987 | Reed | |
| 4,838,250 | A | 6/1989 | Angelo | |
| 4,846,458 | A | 7/1989 | Potts | |
| 4,949,956 | A | 8/1990 | Pobran | |
| 5,071,119 | A | 12/1991 | Johnson | |
| 5,100,131 | A | 3/1992 | Fong | |
| 5,199,933 | A | 4/1993 | Illuzzi | |
| 5,217,487 | A | 6/1993 | Engel et al. | |
| 5,284,458 | A | 2/1994 | Perry et al. | |

(Continued)

*Primary Examiner* — Loan Thanh
*Assistant Examiner* — Tam Nguyen
(74) *Attorney, Agent, or Firm* — Novak Druce + Quigg LLP

(57) ABSTRACT

The invention is directed to an exercise apparatus for use in stretching. The exercise apparatus includes a compact construction that is mechanically easy to operate and allows users to gently stretch, without assistance from others. The exercise apparatus includes a tubular member and a shaft member that is sized to slidably insert into the tubular member to form a telescoping structure that extends in a longitudinal direction. A base is provided having a substantially planar shape that includes an upper surface adapted to receive a force applied in a downward direction. The force is provided to supplement an initial force received through the connector.

10 Claims, 8 Drawing Sheets

U.S. PATENT DOCUMENTS

| | | | | |
|---|---|---|---|---|
| 5,372,566 | A | 12/1994 | Olschansky et al. | |
| 5,389,055 | A | 2/1995 | Gangloff | |
| D356,351 | S | 3/1995 | Watts | |
| D362,479 | S * | 9/1995 | Destasio, Jr. | D21/688 |
| 5,456,649 | A | 10/1995 | Horkey | |
| 5,478,299 | A | 12/1995 | Harmon et al. | |
| 5,509,880 | A | 4/1996 | Becker et al. | |
| 5,540,643 | A | 7/1996 | Fontaine | |
| 5,558,609 | A | 9/1996 | Olschansky et al. | |
| 5,913,756 | A | 6/1999 | Glaser | |
| 5,957,955 | A | 9/1999 | Thomas | |
| D416,959 | S | 11/1999 | Tumminia | |
| D428,942 | S | 8/2000 | Lapointe | |
| 6,179,748 | B1 | 1/2001 | Barr | |
| 6,203,473 | B1 | 3/2001 | Atwood | |
| D460,795 | S | 7/2002 | Fitzpatrick | |
| 6,450,923 | B1 | 9/2002 | Vatti | |
| D463,837 | S | 10/2002 | Tuller et al. | |
| D470,201 | S | 2/2003 | Paull | |
| 6,592,501 | B1 | 7/2003 | Mayes | |
| 6,976,944 | B1 | 12/2005 | Damasio | |
| 7,066,866 | B1 | 6/2006 | Mobley | |
| 2002/0148324 | A1 * | 10/2002 | Bandarra | 74/551.4 |
| 2004/0007089 | A1 * | 1/2004 | Fan | 74/594.1 |
| 2004/0082442 | A1 | 4/2004 | Beedy | |
| 2006/0089239 | A1 * | 4/2006 | Davies, III | 482/91 |
| 2007/0111865 | A1 * | 5/2007 | Patton | 482/91 |

* cited by examiner

PORTABLE AND ADJUSTABLE STRETCHING DEVICE

CROSS-REFERENCE TO RELATED APPLICATION

This application is related to and claims priority to U.S. Provisional Application No. 61/159,171 filed Mar. 11, 2009, entitled PORTABLE, ADJUSTABLE BACK STRETCHING DEVICE, the entirety of which is incorporated herein by reference.

STATEMENT REGARDING FEDERALLY SPONSORED RESEARCH OR DEVELOPMENT n/a

FIELD OF THE INVENTION

The invention generally relates to stretching and muscle lengthening devices. More specifically, the invention relates to portable stretching and muscle lengthening devices that are configured to isolate various muscle groups.

BACKGROUND OF THE INVENTION

As people age, ligaments, tendons and muscles lose flexibility. A sedentary lifestyle and/or lack of exercise may accelerate this loss of flexibility and increases one's chances of injury. Injuries may include cramped muscles, circulation problems, aches and pains. An area of particular sensitivity and discomfort is one's back. Studies have found that poor spinal health is a common contributor to overall pain and discomfort.

Stretching has proven to be effective in returning flexibility to stiffened ligaments, tendons and muscles. As one ages, one's ability to stretch decreases and there become fewer exercises one can perform alone to obtain maximum stretching of ligaments, tendons and muscles in the back. At this point, stretching aides become necessary. While one may hire a personal trainer or rely on a partner to assist with back stretching exercises, this arrangement becomes challenging and expensive, especially for individuals that travel. Alternatively, known stretching devices may be employed to perform back stretching exercises.

While known stationary back stretching machines may be effective, they are bulky. These stationary devices have limited appeal to individuals that reside in confined spaces that do not accommodate fitness equipment. Known portable back stretching devices do not enable users to stretch a wide variety of muscle groups in the back region or provide limited support and are unsafe. For example, known portable back stretching devices target only limited areas of the back, such as the lumbar region. Other portable stretching devices are severe in their traction effect, rendering them uncomfortable or even painful to use. Further still, some known stationary and portable back stretching machines and devices are complicated and require sophisticated technical expertise.

Therefore, what is needed is a portable stretching device that is easy to use, occupies limited space and allows users to target a variety of body regions for stretching, including the back, shoulders, arms, neck, legs and hips. In particular, what is needed is a portable stretching device that stretches all major sections of the back, including the upper, middle, and lower back. Furthermore, what is needed is a portable stretching device that enables users to gently stretch without assistance from others. Still further, what is needed is a portable stretching device that allows users to perform simple stretching motions while applying minimal technical expertise.

SUMMARY OF THE INVENTION

The invention advantageously provides a portable exercise apparatus having a compact construction that is mechanically easy to operate and allows users to target a variety of body regions for stretching, including the back, shoulders, arms, neck, legs and hips. The exercise apparatus allows users to isolate major sections of the back for stretching, including the upper, middle, and lower back. The exercise device allows users to gently stretch, without assistance from others, and to perform simple stretching motions while applying minimal technical expertise.

According to one embodiment, an exercise apparatus is provided for use in stretching. The exercise apparatus includes a tubular member having a first end, a second end, and a hollow interior, the second end being opposite the first end. A shaft member is sized to slidably insert into the tubular member at the first end, the shaft member and the tubular member defining a telescoping structure that extends in a longitudinal direction. A plurality of apertures is provided in the shaft member along the longitudinal direction. A projection located at the tubular structure is provided to engage one of the plurality of apertures and to maintain a relative position between the tubular member and the shaft member. A bracket is coupled to a top surface of the shaft member and a handle is coupled to the bracket. The handle is configured to form an angle with respect to the shaft member. A connector is coupled to the second end of the tubular member and a base is coupled to the connector. The base has a substantially planar shape that includes an upper surface that is adapted to receive a force in a downward direction, the force supplementing an initial downward force received through the connector. According to another embodiment, a connector is provided having a three-dimensional range of movement. According to yet another embodiment, a detachable connector is provided having a three-dimensional range of movement.

These and other features, aspects and advantages of the present invention will become better understood with reference to the following drawings, description and claims.

BRIEF DESCRIPTION OF THE DRAWINGS

A more complete understanding of the invention, and the attendant advantages and features thereof, will be more readily understood by reference to the following detailed description when considered in conjunction with the accompanying drawings wherein.

DETAILED DESCRIPTION OF THE INVENTION

Figure 1:
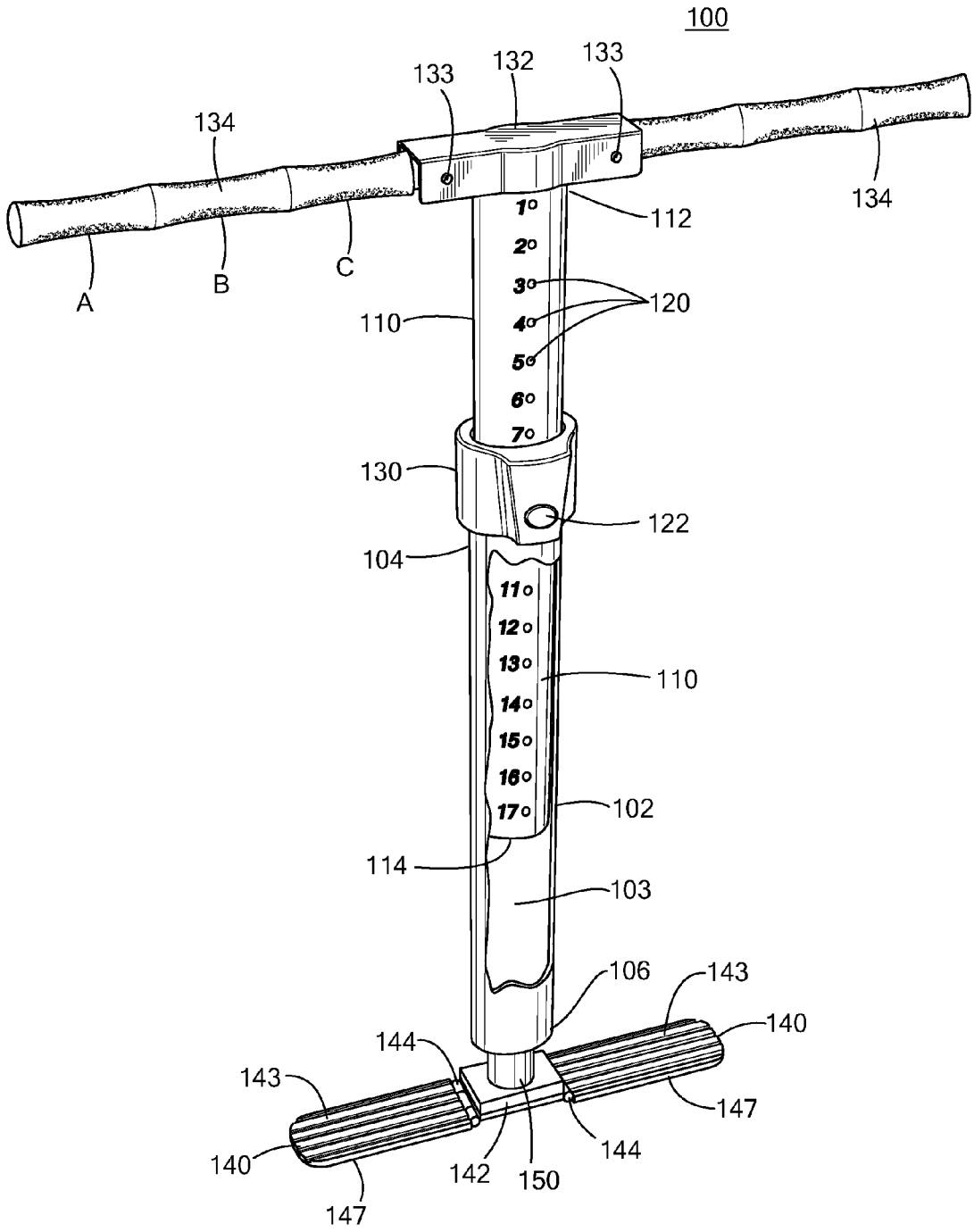
FIG. 1 is a perspective view of an exemplary stretching apparatus constructed in accordance with the principles of the invention.

The following detailed description discloses the presently contemplated best modes of carrying out the invention. This description is not to be taken in a limiting sense, but is made merely for the purpose of illustrating the general principles for embodiments of the invention. Additionally, unless mention is made herein to the contrary, it should be noted that all of the accompanying drawings are not to scale. A variety of modifications and variations are possible in light of the teachings herein, without departing from the scope and spirit of the invention, which is limited only by the appended claims The apparatus components are represented where appropriate by conventional symbols in the drawings, showing only those specific details that are pertinent to understanding the embodiments of the invention so as not to obscure the disclosure with details that will be readily apparent to those of ordinary skill in the art having the benefit of the description herein.

As used herein, relational terms, such as "first" and "second," "top" and "bottom," and the like, may be used solely to distinguish one entity or element from another entity or element without necessarily requiring or implying any physical or logical relationship or order between such entities or elements.

Back pain may originate from several factors including, for example, decreased elasticity or tightness in the back's muscles, ligaments and tendons, among other factors. The spinal column and its contiguous muscles, ligaments, and tendons are all designed to move freely. Any limitations in the motion of these elements may lead to back pain. The invention provides an apparatus for gently stretching the muscles, ligaments, and tendons in the back to relieve strain on the spine and reduce pain caused by tightness in the region of the back.

Accordingly, the invention is directed to an apparatus for stretching and strengthening body regions, including the back, shoulders, arms, neck, trunk, legs and hips, among other body regions. The stretching apparatus is configured and designed for use in a standing or sitting position. For example, users may select standing or sitting positions to obtain different stretching depths, among providing other differences.

According to one embodiment, users may perform omnidirectional stretching by using the apparatus while situated in various positions, including a standing position, a seated position with legs bent and a seated position with legs extended, among other positions. Advantageously, the stretching apparatus provides users with multiple degrees of freedom for stretching and strengthening body regions. For example, the stretching apparatus enables users to stretch in forward, backward and sideway directions while permitting users to perform unrestricted twisting motions. According to one embodiment, the stretching apparatus extends a user's stretching range by pushing out a user's tipping point. The stretching apparatus increases a user's stretching range by providing resistance through the user's tipping point resistance. In other words, the exercise apparatus provides a counterbalance effect. Over time, the stretching apparatus continues to extend a user's stretching range as the user's tipping point adjusts.

Figure 2:
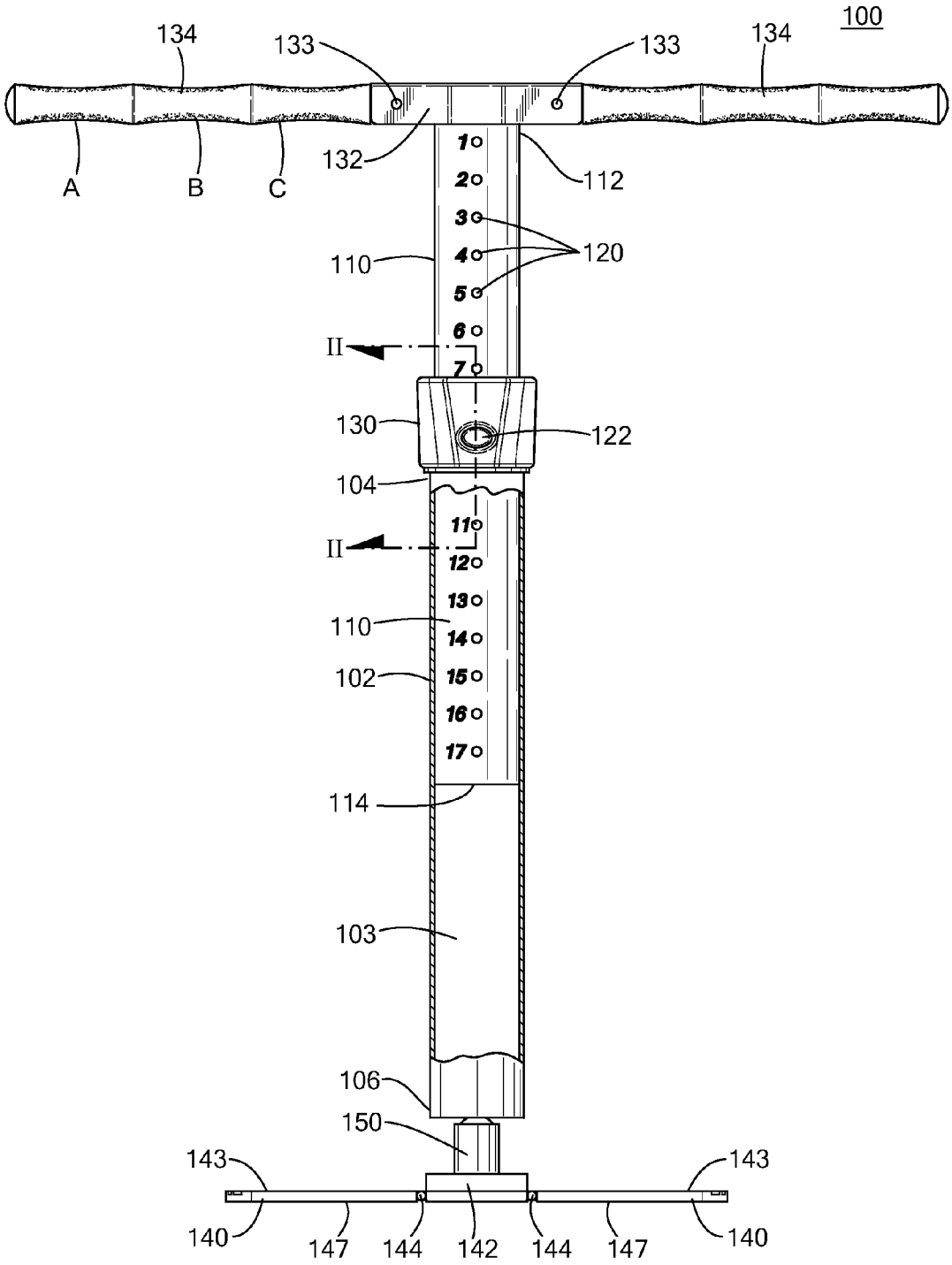
FIG. 2 is a front view of the exemplary stretching apparatus constructed in accordance with the principles of the invention.
Figure 3:
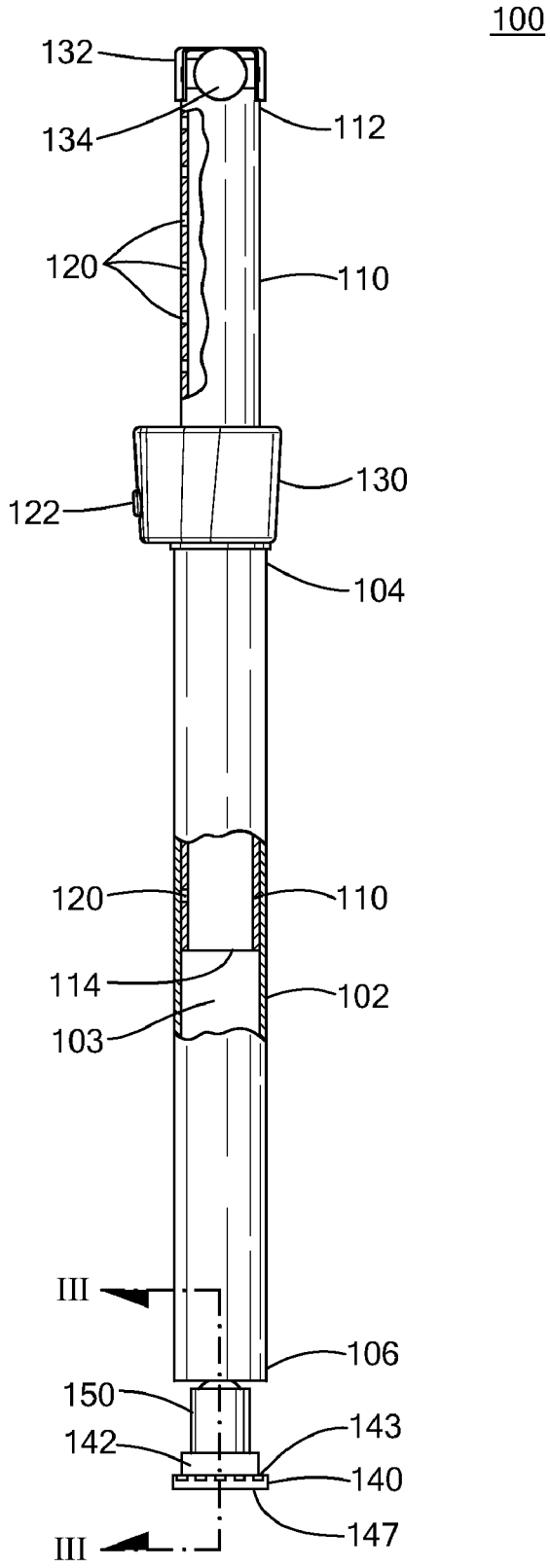
FIG. 3 is a side view of the exemplary stretching apparatus constructed in accordance with the principles of the invention.

As illustrated in FIGS. 1-3, the stretching apparatus 100 includes a tubular member 102, a shaft member 110, a plurality of apertures 120 provided in the shaft member 110, a projection located at the tubular structure (see element 426 in FIG. 4), a bracket 132, a handle 134 coupled to the bracket 132, a connector 150 coupled to the second end 106 of the tubular member 102 and a base 142 coupled to the connector 150. While FIGS. 1 and 2 illustrate two telescoping members 102 and 110, one of ordinary skill in the art will readily appreciate that three or more telescoping members may be used without departing from the principles of the invention. For example, three or more telescoping members may be used to reduce the size of the stretching apparatus during storage, among providing other benefits.

Together, the tubular member 102 (or outer column) and the shaft member 110 (or inner column), form an elongated telescoping structure that extends, or is adjustable, in a longitudinal direction. The shaft member 110 slides within the tubular member 102 and telescopes in a longitudinal direction to create a combined desired height during use or a combined minimal height for storage. For example, during use in a standing position, the stretching apparatus 100 may be adjusted to elbow height, among other heights. While seated, the stretching apparatus 100 may be adjusted to shoulder height, among other heights. Additionally, the stretching apparatus 100 may be adjusted to a desired height based on a user's height and/or preference. It will be readily appreciated that the stretching apparatus 100 may be adjusted to a desired height based up on a user's preference.

According to one embodiment, the shaft member 110 is configured to slide within the tubular member 102. Alternatively, one of ordinary skill in the art will readily appreciate that the stretching apparatus 100 may be designed so that the tubular member 102 is configured to slide within the shaft member 110 without departing from the principles of the invention.

Returning to FIGS. 1 and 2, the tubular member 102 includes a hollow interior 103 for receiving a leading end 114 of the shaft member 110. The leading end 114 of the shaft member 110 may be inserted into the hollow interior 103 of the tubular member 102 through open first end 104. The tubular member 102 includes a second end 106 that is opposite to the first end 104. The second end 106 of the tubular member may be configured to abut the leading end 114. Once a desired height is selected, a locking mechanism 130 may be employed to maintain this desired height. For example, the stretching apparatus 100 may be adjusted to a height of 44 inches or more during use. The locking mechanism 130 may be positioned at the first end 104 of the tubular member 102 to maintain a relative position between the tubular member 102 and the shaft member 110. One of ordinary skill in the art will readily appreciate that the locking mechanism 130 may be positioned at other locations on the tubular member 102 and the shaft member 110.

Figure 4:
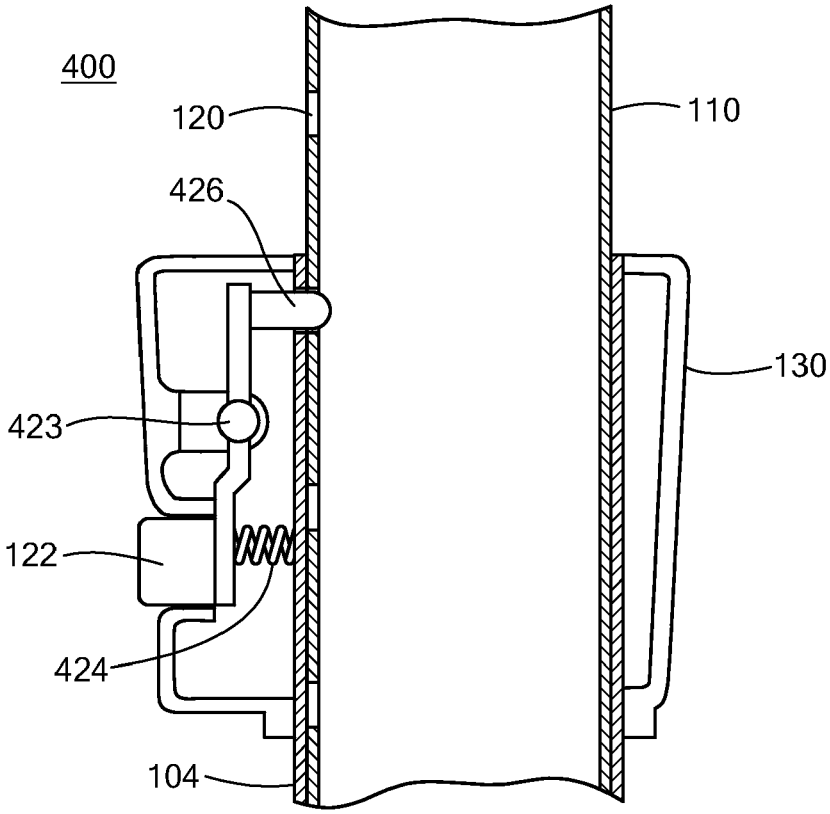
FIG. 4 is a section view of a locking mechanism taken along line II-II in FIG. 2 in accordance with the principles of the invention.

As illustrated in FIG. 4, the locking mechanism 130 may include a projection 426 that engages one of the apertures 120 provided along the longitudinal direction of the shaft member 110. The locking mechanism 130 may include a button 122 that is biased by spring 424. When the button 122 is pressed, the projection 426 is configured to pivot about pin 423, thereby extracting the projection from a corresponding aperture 120. Upon removal of projection 426 from the corresponding aperture 120, the tubular member 102 and the shaft member 110 are free to slide relative to each other in the longitudinal direction. When a desired height is selected, the button 122 may be released causing the projection 426 to contact an outer surface of the shaft member 110 until the projection 426 engages the appropriate aperture 120. When the projection 426 is received by the appropriate aperture 120, the tubular member 102 and the shaft member 110 are locked in the longitudinal direction relative to each other. In this configuration, the tubular member 102 and the shaft member 110 do not rotate relative to each other. This process may be repeated to again select a desired height. One of ordinary skill in the art will readily appreciate that other locking mechanisms may be used. For example, an alternative locking mechanism may be provided to permit the shaft member 110 to rotate inside of the tubular member 102 while maintaining a desired height between the shaft member 110 and the tubular member 102.

According to one embodiment, the tubular member 102, the shaft member 110 and the locking mechanism 30, including the projection 426, may be made from any sturdy material, including for example wood, metal, plastic, or a combination thereof, among other sturdy materials. Lightweight materials are desirable. While the tubular member 102, the shaft member 110 and the projection 426 are illustrated to include circular cross-sectional shapes, one of ordinary skill will readily appreciate that the tubular member 102, the shaft member 110 and the projection 426 may be formed to include any desired cross-sectional shape, including for example circular, oval, polygonal, X-shaped, U-shaped, among other cross-sectional shapes. According to one embodiment, the tubular member 102 and the shaft member 110 may be dimensioned to be 30 inches or more in length, for example. Smaller dimensions may be used. Furthermore, the tubular member 102 and the shaft member 110 may include a diameter of 2 inches or more. Smaller dimensions may be used. For example, shaft member 110 may be dimensioned to be 32 inches in length and may have an outer diameter measuring 3⅜ inches. Smaller or larger dimensions may be used. The tubular member 102 may be dimensioned to be 31 inches in length and may have an inner diameter measuring 3½ inches, for example. Smaller or larger dimensions may be used. One of ordinary skill in the art will readily appreciate that other dimensions may be used.

The stretching apparatus 100 may include a bracket 132 that is secured to a top surface 112 of the shaft member 110. The bracket 132 may be fixedly secured to the shaft member 110 using one or more of a plurality of securing techniques, including welding or adhesive, among other securing techniques. Alternatively, the bracket 132 may be removably secured to the shaft member 110 using one or more of a plurality of securing techniques, including using screws, bolts or pins, among other securing techniques. A combination of securing techniques also may be employed.

The bracket 132 may include securing mechanisms 133 that pivotally couple handles 134 to each side of the bracket 132. For example, the securing mechanisms may include pins or bolts, among other securing mechanisms. One of ordinary skill in the art will readily appreciate that other handle configurations may be used.

According to one embodiment, the handles 134 may be positioned to form an angle with respect to the shaft member 110. During use, the handles 134 may be positioned to form a substantially right angle with respect to the shaft member 110. Alternatively, during use, the handles 134 may be positioned to form acute angles with respect to the shaft member 110. To minimize use of space during non-use, the handles 134 may be positioned to be substantially parallel with respect to the shaft member 110. The handles 134 may include apertures (not shown) that receive the securing mechanisms 133 and a locking structure (not shown) to maintain a handle position relative to the shaft member 110. According to one embodiment, the shaft member 110 may be configured to structurally support to the handles 134.

Figure 6:
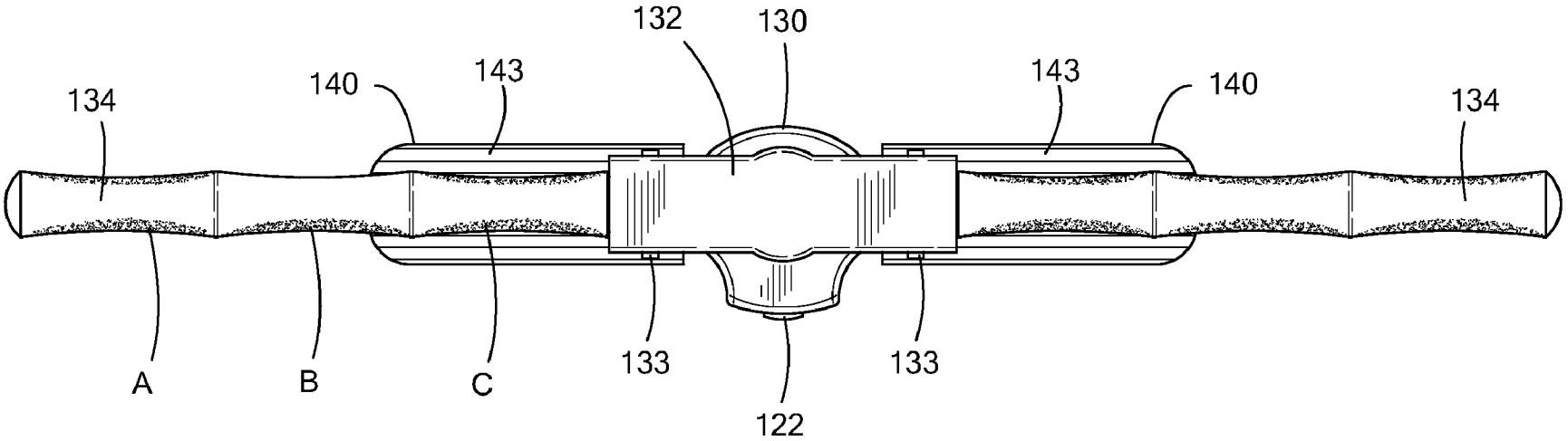
FIG. 6 is a top view of the exemplary stretching apparatus constructed in accordance with the principles of the invention.

FIGS. 1, 2 and 6 illustrate that the handles 134 may be shaped as a long, thin cylindrical handles having a circular cross section. One of ordinary skill will readily appreciate that the handles 134 may be formed to include any desired cross-sectional shape, including for example circular, oval, polygonal, among other cross-sectional shapes. According to one embodiment, the handles 134 may be dimensioned to be 36 inches or more in length, for example. Smaller dimensions may be used. Furthermore, the handles 134 may include a diameter of 2 inches or more. Smaller dimensions may be used. For example, the handles 134 may be dimensioned to be 15 inches in length and may have an outer diameter measuring 1¼ inches. One of ordinary skill in the art will readily appreciate that smaller or larger dimensions may be used.

The handles 134 may be configured to include a plurality of sections for gripping. For example, the handles may include three gripping sections A, B and C that allow for at least three different gripping positions. Section A may provide a wide gripping position, section B may provide an intermediate gripping position and section C may provide a tight gripping position. The various gripping sections may be used to target stretching of different regions of the body, including back, shoulders, arms, neck, trunk, legs and hips, among other body regions. In other words, users may grip the handles 134 at different distances relative to the bracket 132 to isolate different regions of the body, including different muscle groups.

The handles 134 may be constructed from any sturdy materials, including for example wood, metal, plastic, or a combination thereof, among other sturdy materials. Lightweight materials are desirable. The handles 134 may be covered with soft padding materials, including for example foam, rubber, plastic, gel, fluid, cloth, soft textile, synthetic material, among other padding materials. The covering may be shaped for comfort and may include various configurations that are comfortable to grip. According to one embodiment, the covering may extend over an entire length of the handles 134. Alternatively, the covering may extend over less than the entire length of the handles 134. Further, the covering may have a different grip shapes for left hands and right hands.

The stretching apparatus 100 may include a base 142 that is coupled to the second end 106 of the tubular member 102 through a connector 150. The base 142 is provided support the stretching apparatus 100 while vertically oriented. The base 142 may be coupled to a plurality of pedals 140 having a substantially planar shape. Alternatively, the base 142 may be coupled to a pedal having a single structure, such as a disc, rectangle, square or other single structure. The pedals 140 may be formed from a sturdy material, including for example wood, metal, plastic, hard rubber or a combination thereof, among other materials. The pedals 140 may be coated with a tacky material to resist slipping, including for example rubber or gritty paper, among other materials. The pedals 140 may be formed in a rectilinear shape, curvilinear shape, disc shape or U-shape, among other shapes, to permit users to step or sit upon the pedals 140. According to one embodiment, the pedals 140 may be sized to accommodate an average sized human foot. For example, the pedals 140 may be dimensioned to be of 5 inches by 7 inches. Smaller or larger dimensions may be used. According to a one embodiment, the span of a base 142 and pedals 140 are configured to be smaller than the span of the handles 134. The pedals 140 may be coupled to the base 142 using hinges 144. The hinges 144 permit the pedals 140 to fold up for easy storage during non-use. Alternatively, the pedal 140 may be non-hinged and thus not capable of folding.

The pedals 140 include an upper surface 143 having grooves that provide a friction pattern. The pedals 140 are sized to enable users to apply weight thereon, including by stepping, sitting or otherwise depressing the pedals 140. The weight applied on the pedals 140 generates a force in a downward direction that supplements an initial downward force transferred to the base 142 through the handles 134, the telescoping members 102, 110 and the connector 150. The weight that is applied to the pedals 140 by stepping, sitting, or otherwise depressing the pedals 140 causes a bottom surface 147 of the pedals 140 to frictionally grip an underlying surface or foundation beneath the stretching apparatus 100. In other words, the supplemental force applied in the downward direction to the pedals 140 prevents the stretching apparatus 100 from slipping when the stretching apparatus 100 is subjected to lateral forces during use. Additionally, if the user loses her balance during use and steps off the pedals and away from the device, the supplemental force applied to the pedals 140 will be alleviated and the stretching apparatus 100 will be permitted to safely fall, preventing injury to the user.

According to one embodiment, the pedals 140 may form a substantially perpendicular angle with respect to the tubular member 102. Alternatively, the pedals 140 may rest flat on an underlying surface or foundation and may form an acute or obtuse angle with respect to the tubular member 102.

Figure 5:
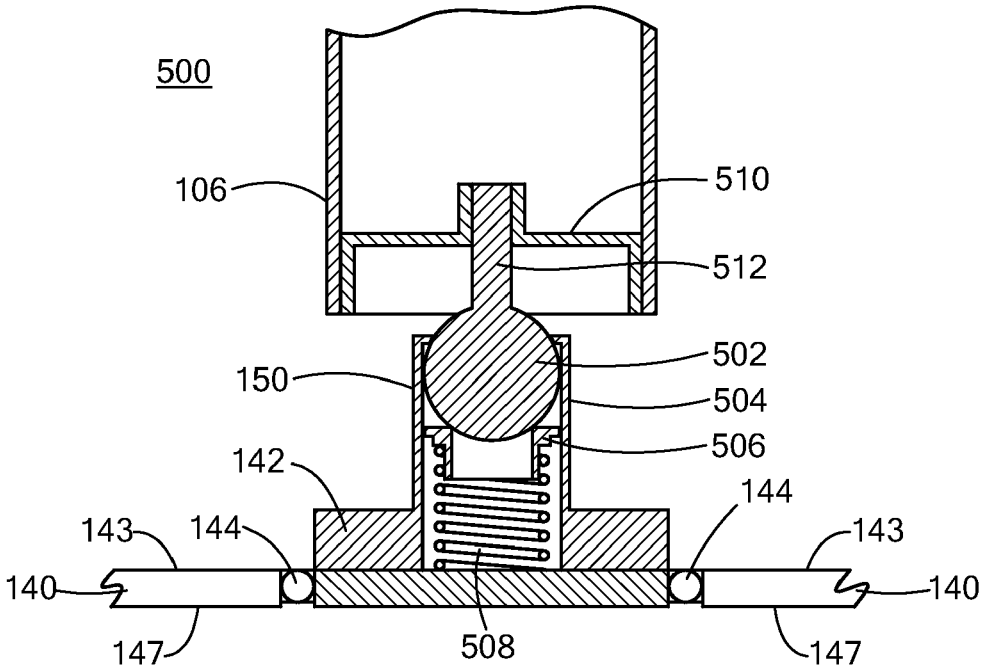
FIG. 5 is a section view of a ball and socket connector taken along line III-III in FIG. 3 in accordance with the principles of the invention.

The connector 150 is provided to couple the base 142 to the second end 106 of the tubular member 102. As illustrated in FIG. 5, the connector 150 may include a ball 502 and socket 504 structure. The ball 502 and socket 504 structure may include a securing clip 506 and spring 508. The ball 502 may be secured to a support 510 through a shaft 512. The shaft 512 may be threaded and screwed into the support 510. Alternatively, other securing techniques may be used to fixedly secure the ball 502 to the support 510. The ball 502 and socket 504 structure enables users to perform omni-directional stretching using the stretching apparatus 100. In other words, the ball 502 and socket 504 structure provide the stretching apparatus 100 with multiple degrees of freedom for stretching and strengthening a plurality of body regions. The ball 502 and socket 504 structure allows the tubular member 102, the shaft member 110 and the handles 134 to rotate and tilt freely relative to an axis passing orthogonally through the base 142.

The connector 150 allows the stretching apparatus 100 to pivot in three dimensions by tilting forward, backward, and sideways. The stretching apparatus is designed to form various angles relative to a longitudinal axis defined perpendicular to the base 142 positioned on the ground. The connector 150 further permits the stretching apparatus to rotate 360 degrees about a longitudinal axis defined perpendicular to the base 142. The connector 150 allows the pedals 140 to remain stationary while the tubular member 102, the shaft member 110 and the handles 134 move, pivot and rotate in three dimensional space. The connector 150 is configured to allow the tubular member 102 and the shaft member 110 to rotate and move freely relative to a longitudinal axis defined perpendicular to the base 142.

According to another embodiment, the connector 150 may include a detachable connector. For example, the connector 150 may include a detachable ball and socket structure. The base 142 having the socket 504 may be permanently or detachably affixed to a surface, including planar or convex surface, among other surfaces. The surface may include a recess, or concave portion, for receiving the base 142 and socket 504. Alternatively, the surface may include a convex portion for receiving the base 142 and socket 504. The exercise apparatus 100 having the affixed ball structure 502 may be detachably coupled to the socket 504 in the base 142 during use. However, during non-use, the exercise apparatus 100 having the ball 502 may be released from the base 142 and socket 504 and stored separately. One of ordinary skill will readily appreciate that the base 142 may be configured to receive the ball 502 and the exercise apparatus may be configured to receive the socket 504. Alternatively, one of ordinary skill will readily appreciate other detachable structures may be used.

According to another embodiment, the stretching apparatus 100 may rest upon a blunt end cap (not shown) that is affixed to the second end 106 of the tubular member 102. The blunt end cap may be configured to resist slipping and may be made from tacky materials, including for example rubber or coated wood, metal, plastic, or a combination thereof, among other materials. The blunt end cap may be configured to allow the device to rotate and/or tilt along a longitudinal axis defined by the tubular member 102 and the shaft member 110.

Figure 7:
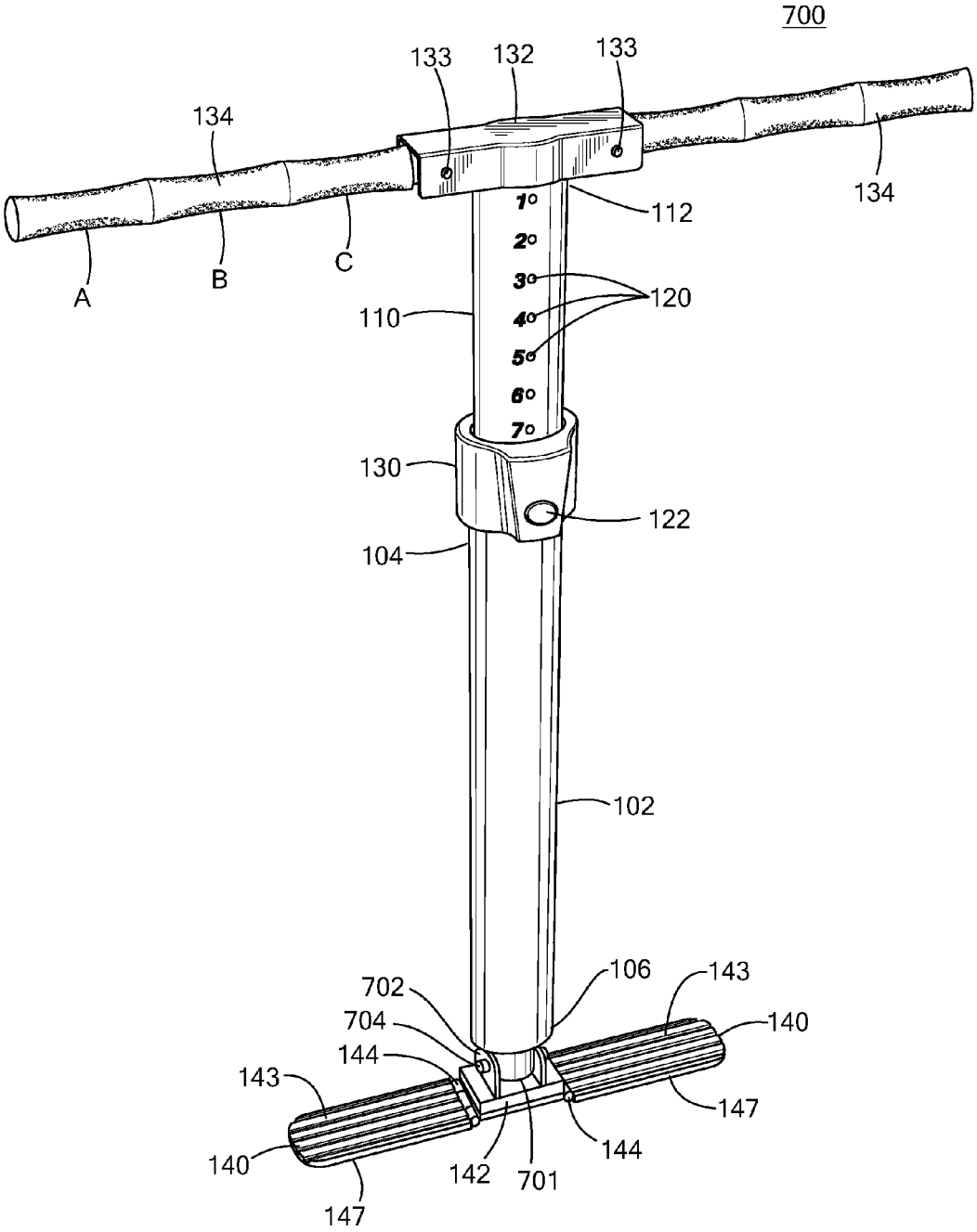
FIG. 7 is a perspective view of another exemplary stretching apparatus constructed in accordance with the principles of the invention.

FIG. 7 illustrates an alternate embodiment of the stretching apparatus 100 having a hinged connector 701. The hinged connector 701 may include a support structure 702 anchored to the base 142. A shaft is positioned within the support structure 702 and receives a pivot pin 704. The hinged connector 701 is configured to pivot 180 degrees about a longitudinal axis that is perpendicular to the base 142. Additionally, the hinged connector 701 may be configured to rotate 360 degrees about a longitudinal axis that is perpendicular to the base 142. The hinged connector 701 enables the stretching apparatus 100 to tilt in forward and backward directions while rotating. The hinged connector 701 does not facilitate movement of the stretching apparatus 100 in the sideways directions.

Figure 8:
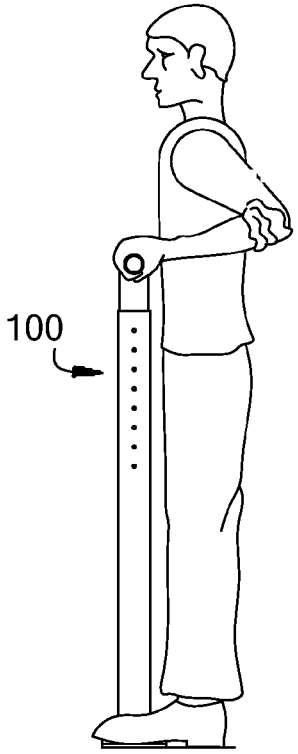
FIGS. 8-12 illustrate views of the exemplary stretching apparatus constructed in accordance with the principles of the invention in use.

FIGS. 8 to 12 illustrate exemplary embodiments of the stretching apparatus 100 in use. FIG. 8 illustrates preparing the stretching apparatus 100 for use. With the stretching apparatus 100 adjusted to a desired height, the pedals are placed flat on the ground and the user's feet are placed over the pedals. The handles are positioned parallel to the ground and the exercise apparatus 100 is positioned perpendicular to the ground.

Figure 9:
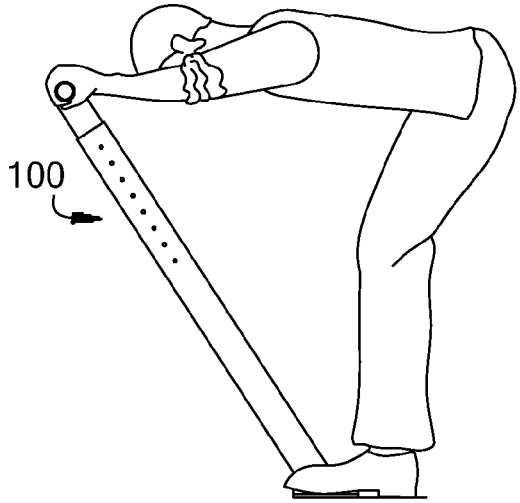

FIG. 9 illustrates a user grasping the stretching apparatus 100 in a standing position while leaning in a forward direction and extending their arms accordingly. The stretch position may be held for approximately 30 seconds at a time and may be repeated approximately 3-5 times or more per set. Fewer repetitions may be used.

Figure 10:
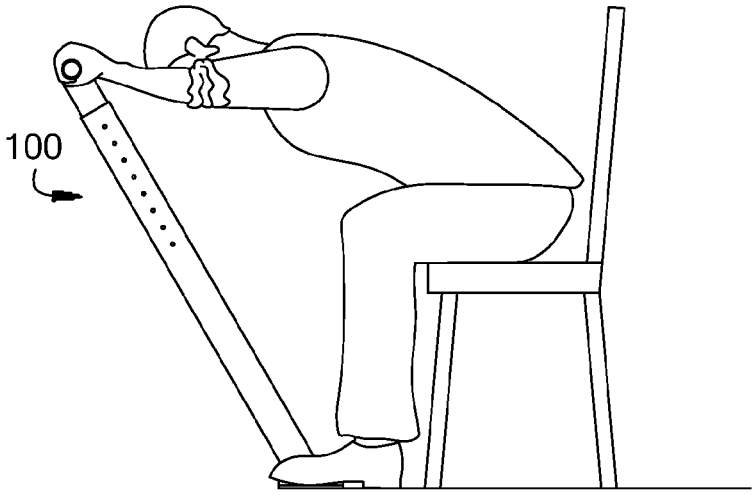

FIG. 10 illustrates an alternative embodiment with the user grasping the stretching apparatus 100 in a sitting position with legs bent while leaning in a forward direction and extending their arms accordingly. The user steps on the pedals and extends their arms in a forward direction. The stretch position may be held for approximately 30 seconds at a time and may be repeated approximately 3-5 times or more per set. Fewer repetitions may be used.

Figure 11:
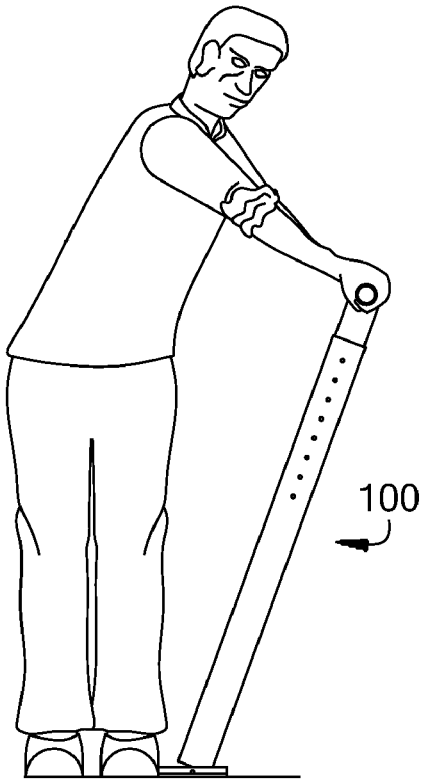

As illustrated in FIG. 11, the stretching apparatus 100 may be adapted to perform lateral, trunk and abdominal stretching. A user may orient the stretching apparatus 100 to one side and may step on one pedal 140. The user may push the stretching apparatus 100 away from their body in a sideways direction using different hand positions to isolate different muscle groups.

Figure 12:
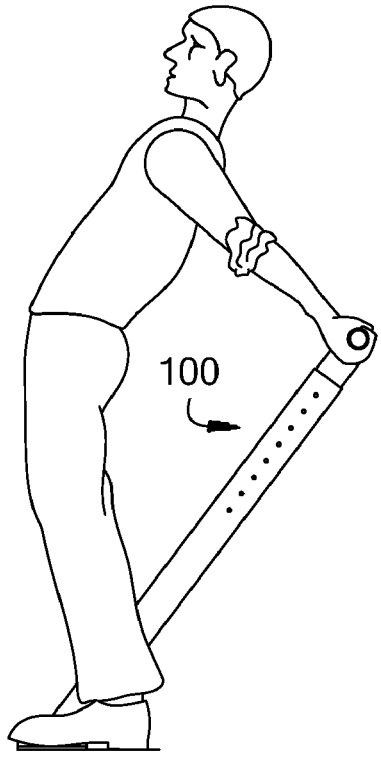

Alternatively, as illustrated in FIG. 12, the stretching apparatus 100 may be placed behind a user. In this position, the user may place their heels on the pedals 140. The user may extend their arms behind and away from their body to engage in an abdominal, arm, and shoulder stretches.

It should be understood, of course, that the foregoing relates to exemplary embodiments of the invention and that modifications may be made without departing from the spirit and scope of the invention as set forth in the following claims.

What is claimed is:

1. An exercise apparatus for use in stretching, the exercise apparatus comprising:

a tubular member having a first end, a second end, and a hollow interior, the second end being opposite the first end;

a shaft member that is sized to slidably insert into the tubular member at the first end, the shaft member and the tubular member defining a telescoping structure that extends in a longitudinal direction;

a plurality of apertures provided in the shaft member along the longitudinal direction;

a projection located at the tubular member to engage one of the plurality of apertures and to maintain a relative position between the tubular member and the shaft member;

a bracket coupled to a top surface of the shaft member;

a handle assembly including two handles, each handle being pivotally secured to opposite ends of the bracket and each handle being configured to form an angle with respect to the shaft member, wherein a securing mechanism of the bracket is adjustable to fix each handle in a position substantially perpendicular to the shaft member, a position forming an acute angle to the shaft member and a position substantially parallel to the shaft member;

a connector coupled to the second end of the tubular member; and a base coupled to the connector, the base includes a pair of hinged pedals, each hinged pedal being adjustable to extend substantially perpendicular to the tubular member during use and substantially parallel to the tubular member during storage, wherein each hinged pedal has a planar shape that is covered with a material to resist slipping, an upper surface having grooves that provide a friction pattern and is adapted to frictionally receive a foot thereon, and a bottom surface that is flat to frictionally engage an underlying floor covered with a gritty material to resist slipping, the base including:

an upper surface having grooves that provide a friction pattern, the upper surface being adapted to frictionally receive a foot thereon; and a bottom surface that is flat to frictionally engage an underlying floor, thereby preventing the base from slipping.

2. The exercise apparatus according to claim 1, wherein the tubular member includes a cross-sectional shape selected from one of circular, oval, triangular or polygonal.

3. The exercise apparatus according to claim 1, wherein the shaft member includes a cross-sectional shape selected from one of circular, oval, triangular or polygonal.

4. The exercise apparatus according to claim 1, wherein the securing mechanism includes a pin.

5. The exercise apparatus according to claim 1, wherein each handle includes a length of at least 20 inches so that the combined length of the handle assembly is at least 40 inches.

6. The exercise apparatus according to claim 5, wherein each handle provides at least three gripping regions, including a narrow gripping region, a medium gripping region and a wide gripping region.

7. The exercise apparatus according to claim 1, wherein the connector includes one of a ball and socket connector and a hinged connector.

8. The exercise apparatus according to claim 1, wherein the base is formed in a rectilinear shape.

9. The exercise apparatus according to claim 8, wherein the upper surface of the base has at least 4 grooves formed thereon to enhance friction.

10. An exercise apparatus for use in stretching, the exercise apparatus comprising:

a tubular member having a first end, a second end, and a hollow interior, the second end being opposite the first end;

a shaft member that is sized to slidably insert into the tubular member at the first end, the shaft member and the tubular member defining a telescoping structure that extends in a longitudinal direction;

a plurality of apertures provided in the shaft member along the longitudinal direction;

a projection located at the tubular member to engage one of the plurality of apertures and to maintain a relative position between the tubular member and the shaft member;

a bracket coupled to a top surface of the shaft member;

a handle assembly including two handles, each handle being pivotally secured to opposite ends of the bracket and each handle being configured to form an angle with respect to the shaft member, wherein a securing mechanism of the bracket is adjustable to fix each handle in a position substantially perpendicular to the shaft member, a position forming an acute angle to the shaft member and a position substantially parallel to the shaft member;

a detachable connector coupled to the second end of the tubular member, the connector providing a three-dimensional range of movement; and a base coupled to the connector, the base includes a pair of hinged pedals, each hinged pedal being adjustable to extend substantially perpendicular to the tubular member during use and substantially parallel to the tubular member during storage, wherein each hinged pedal has a planar shape that is covered with a material to resist slipping, an upper surface having grooves that provide a friction pattern and is adapted to frictionally receive a foot thereon, and a bottom surface that is flat to frictionally engage an underlying floor covered with a gritty material to resist slipping, the base including:

an upper surface having grooves that provide a friction pattern, the upper surface being adapted to frictionally receive a foot thereon; and a bottom surface that is flat to frictionally engage an underlying floor, thereby preventing the base from slipping.

* * * * *